US005415449A

United States Patent [19]

Kentner, Sr.

[11] Patent Number: 5,415,449

[45] Date of Patent: May 16, 1995

[54] DRAW BAR SLING

[75] Inventor: Michael J. Kentner, Sr., Long Beach, Calif.

[73] Assignee: BC Industrial Supply, Inc., Orange, Calif.

[21] Appl. No.: 129,987

[22] Filed: Sep. 30, 1993

[51] Int. Cl.[6] ..... B66C 1/12

[52] U.S. Cl. ..... 294/74

[58] Field of Search ..... 294/74–77; 57/201, 210, 224; 24/122.3, 122.6

[56] References Cited

U.S. PATENT DOCUMENTS

| | | | |
|---|---|---|---|
| 2,793,904 | 5/1957 | Gale | 294/74 |
| 3,707,021 | 12/1972 | Norrman . | |
| 4,052,095 | 10/1977 | Johnson | 294/74 |
| 4,093,292 | 6/1978 | Marcet et al. | 294/74 |
| 4,210,089 | 7/1980 | Lindahl . | |
| 4,232,619 | 11/1980 | Lindahl . | |
| 4,421,352 | 12/1983 | Rave et al. | 294/74 |
| 4,534,262 | 8/1985 | Swenson | 57/210 X |
| 4,850,629 | 7/1989 | St. Germain . | |

*Primary Examiner*—Dean J. Kramer
*Attorney, Agent, or Firm*—Harold L. Jackson

[57] ABSTRACT

A draw bar sling for lifting heavy loads such as railroad cars includes a lightweight rigid U-shaped saddle made, for example, of an aluminum alloy, having a central shelf for engaging the coupler tongue of the car and a concave passageway extending under the central section. A loop sling comprising a core bundle of high performance fibers, encased in a tubular abrasion resistant covering, extends in through the passageway to form two closed curve eye sections above the saddle through which a crane hook can be inserted to lift the coupler tongue. A cut proof sleeve surrounds each eye section to prevent the hook from cutting the high performance fibers. The cut proof sleeve comprises multiple layers of high performance fibers, and particularly Spectra, woven at right angles and sewn between sheets of abrasion resistant material.

14 Claims, 2 Drawing Sheets

DRAW BAR SLING

BACKGROUND OF THE INVENTION

1. Field of the Invention

The present invention relates to lifting slings and more particularly to lift slings designed for lifting heavy loads such as railroad cars.

2. Description of the Prior Art

Slings for lifting heavy objects such as railroad cars currently comprise a steel saddle or arc adapted to be inserted under a railroad car coupler tongue and a steel rope or cable which passes around the arch with a loop or eye at each end for receiving a hook attached to a crane line or cable. Railroad cars typically weigh between about 30 and 100 tons. A standard sling for lifting each end of the small 30 ton car is made of eight parts of ⅝" inches diameter wire rope and generally weighs about 110 pounds (lbs.). Steel slings for lifting a 60 ton car weigh about 210 lbs.

Two to four men are normally required to lift and position each sling in the confined area under the coupler tongue of the cars. It is not uncommon for workers to sustain injuries to their hands, feet or back in positioning the sling from their sheer mass and weight. Further, wires from the strands of wire rope can, and not infrequently do, break exposing workers to hazardous sharp wire ends which may result in serious hand or arm lacerations.

Slings comprising a core of parallel high tensile strength threads and yarns, such as polyester etc., encased in a protective cover, made of a similar material, are known. See, for example, U.S. Pat. Nos. 3,707,021, 4,232,619, 4,210,089, and 4,850,629. While such synthetic fiber slings are considerably lighter than steel rope, they would not be suitable for lifting objects such as railroad cars. First, the coupler tongue would create highly localized stress points in the sling tending to cut or abrade the covering and core. Second, the ends of the sling which loop around the crane hook would be subject to being cut and/or abraded.

There is a need for a light weight lifting sling which is capable of reliably lifting of heavy objects such as railroad cars.

SUMMARY OF THE INVENTION

A draw bar or lifting sling in accordance with the present invention includes a rigid U-shaped saddle having a central shelf section for engaging a load such as a railroad car coupler tongue and a passageway extending under the central section for receiving a sling. The saddle may be made of a lightweight, high strength, aluminum alloy. A loop sling comprising a core bundle of high performance endless parallel fibers enclosed in an outer tubular abrasion resistant covering is inserted through the passageway in the saddle. The sides of the loop extend in a side by side relationship to form longitudinally extending parallel segments terminating at each end in a close curve or eye section through which a crane hook can be inserted for lifting the sling. The parallel segments portion of the loop sling extend through the passageway in the saddle.

A cut proof and abrasion resistant sleeve surrounds the tubular protective covering along each closed curve section to substantially prevent a crane hook or other lifting member from penetrating into the covering and high performance fiber core. The cut proof sleeve comprises multiple layers of high performance fibers (and particularly Spectra fibers) woven at right angles and sewn between inner and outer sheets of abrasion resistant material. The high performance fibers of the loop sling and cut proof sleeve have a tensile strength to weight ratio within the range of about 20 to 30 grams per denurs (GPD).

The features of the present invention can best be understood from the following description taken in conjunction with the accompanying drawings.

DESCRIPTION OF THE PREFERRED EMBODIMENT

Figure 1:
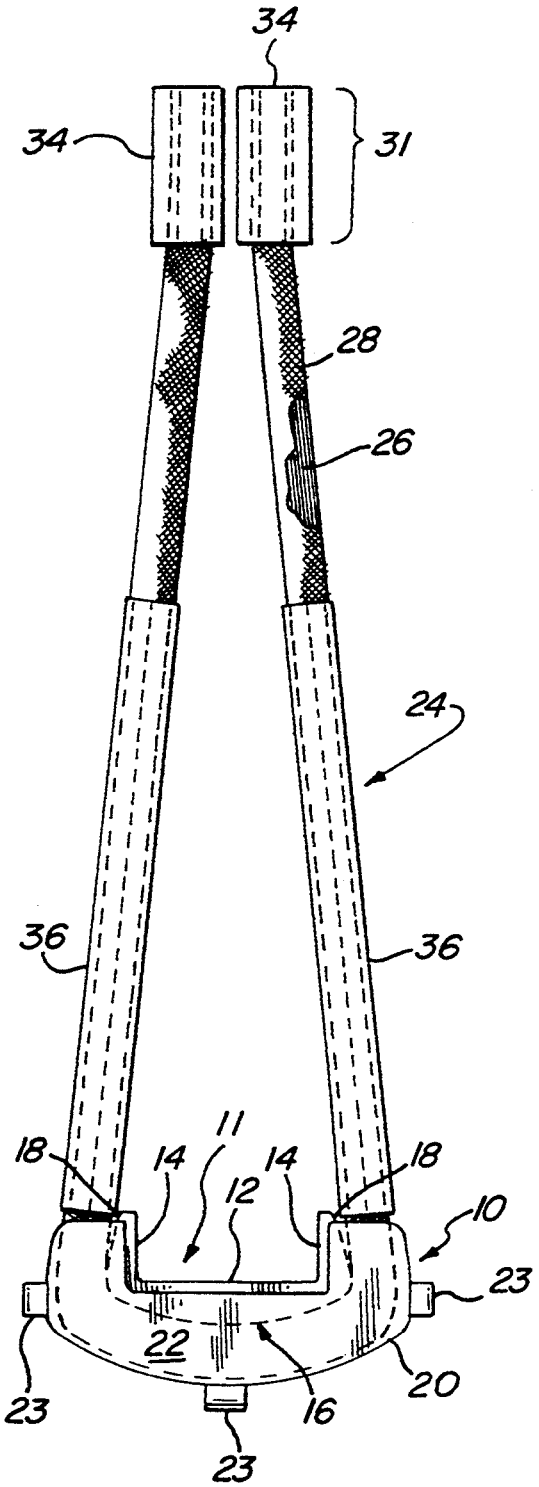
FIG. 1 is a side elevational view of a draw bar sling in accordance with the present invention.
Figure 2:
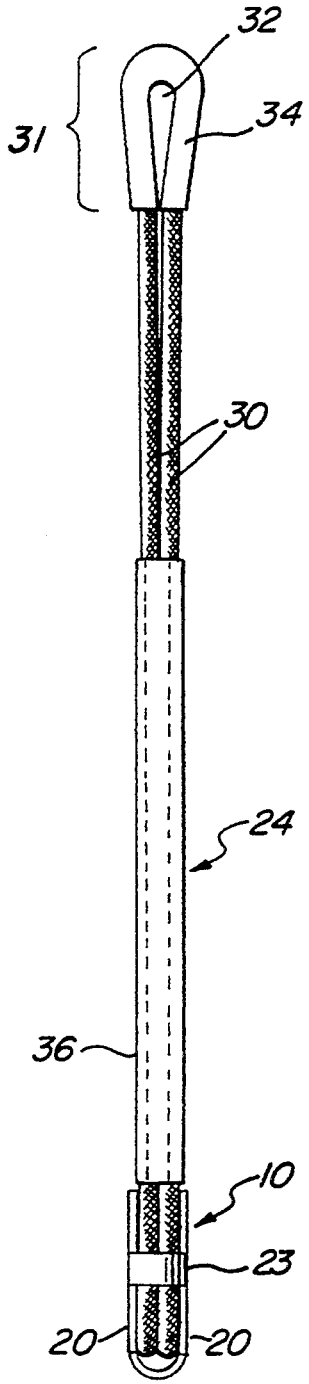
FIG. 2 is an end elevational view of the sling of FIG. 1.
Figure 3:
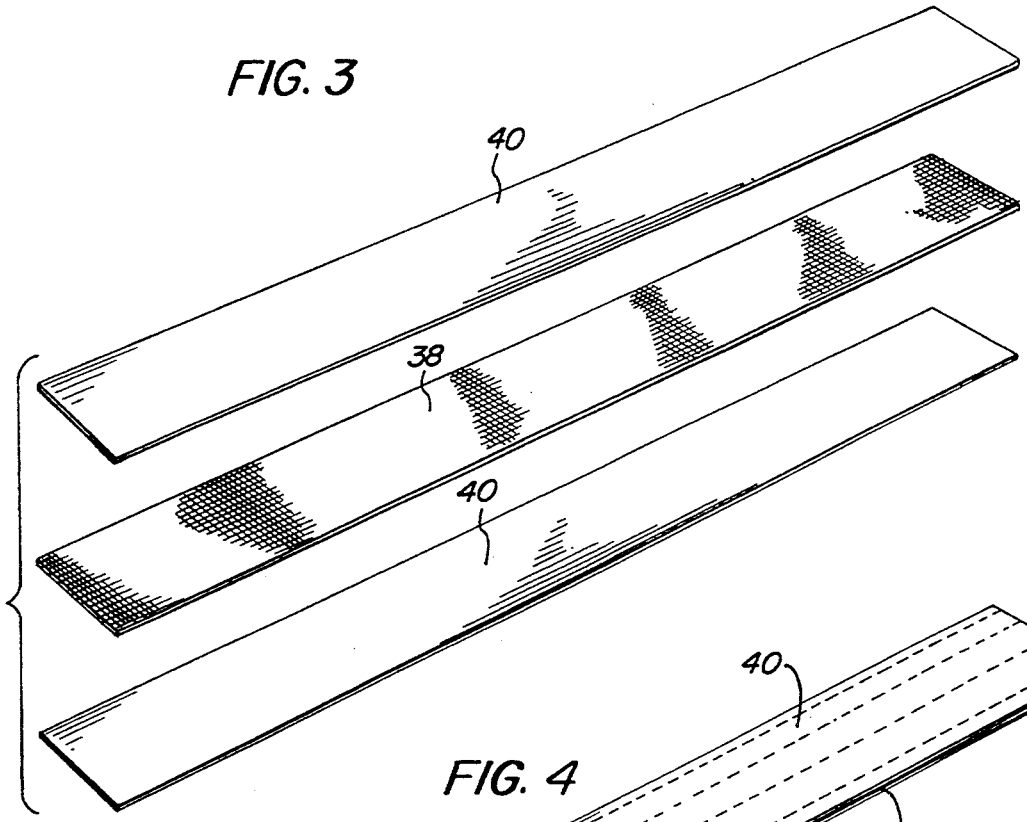
FIG. 3 is an exploded perspective view of the components of the cut proof sleeve in planar form.
Figure 4:
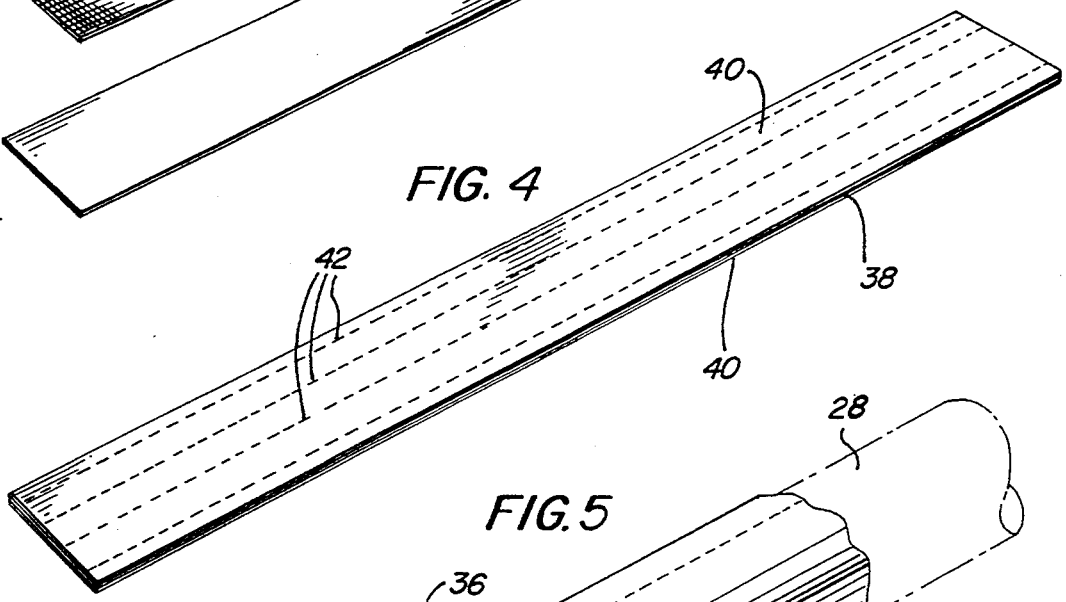
FIG. 4 is a perspective view of the sleeve of FIG. 3 in its assembled planar form.
Figure 5:
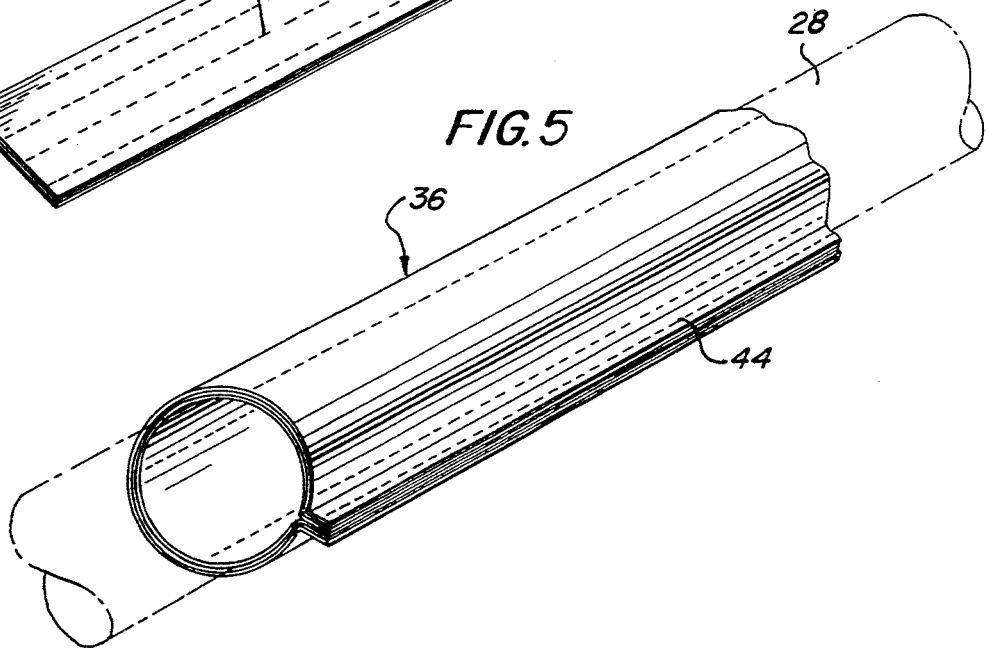
FIG. 5 is a perspective view of the sleeve of FIG. 4 wrapped around a portion of the sling.

Referring now to the drawings a saddle or arc 10 includes a center section 11 in the form of a flat shelf 12 and end walls 14 extending upwardly at right angles to the plane of the shelf. An arcuate surface 16 extends under the shelf 12 and joins the upper portion 18 of each end wall 14 as illustrated. A side wall 20 extends downwardly and outwardly from each edge of the shelf 12 and at right angles thereto to form a protected convex passageway 22 which extends under and around the sides of the center section. U-shaped tabs 23 are secured, for example, by welding between the outer edges of the side walls . The tabs 23 add structural integrity to the saddle while enabling an operator to easily insert a loop sling 24 through the passageway 22. The saddle may be cast of a high strength aluminum alloy such as $T_2$. The shelf 12 of the saddle is preferably about 9 inches long and 2 inches wide. The convex surface extending under the center section preferably has a radius of about 12 inches.

The loop sling 24 comprises a core bundle of high performance fibers 26 twisted into parallel yarns which are wound into an endless loop in a well known manner. The high performance fibers have a strength to weight ratio in excess of 20 GPD and preferably within the range of about 20 to 30 GPD. Most preferably the fibers have a strength to weight ratio within the range of 23 to 27 GPD. Kevlar aramid and Spectra fibers provide a strength to weight ratio of 23 and 27 GPD, respectively, and are ideally suited for the core. We have found that a blend of Kevlar and Spectra fibers (50/50) twisted into yarns result in a core (and sling) which is easy to manipulate and provides a reliable lifting element with a strength to weight ratio of about 26 GPD. The yarns are preferably about ¼" in diameter.

The core of endless fiber yarns is encased in a protective tubular covering 28 with the ends thereof sewn or otherwise fastened together to form a loop sling. The protective covering may be made of an abrasion or wear resistant material such as Cordura. Kevlar and Cordura are trademarks of E.I. Dupont Nemours, and Spectra is a trademark of Allied Signal. Such high performance fibers have a maximum stretch of about 0.0001% at rated load and are about 90% lighter than steel with a comparable lifting capacity. The diameter of the tubular covering is chosen to restrain any movement of the fiber yarns therein. The overall diameter of the sling may run from 1 to 4½ inches to provide lifting capacities from 30 to 100 or more tons.

The sides of the loop sling extend in a side by side relationship to form longitudinally extending parallel leg segments 30 which terminate at each end in a closed curve or eye section 31 forming an opening 32 through which a hook, secured to a crane cable, for example, can be inserted for lifting the sling. The center portion of the sling is inserted through the passageway 22 in the saddle so that the eye sections 32 are spaced substantially equidistant from the saddle as illustrated. The sling may be of any convenient length and I have found that a length of about 5½ feet is sufficient for most lifting operations.

A cut proof or cut resistant sleeve 34 surrounds the tubular protective covering 28 along each closed curve section 31 to prevent a crane hook or other lifting member from penetrating into the protective covering 28 and the high performance fibers 26. An additional cut proof sleeve 36 may be placed around the lower portion of adjacent leg segments of the loop sling above the saddle as illustrated. The additional cut proof sleeves 36 serve to maintain each pair of parallel leg segments 30, which extend above the saddle, together for ease in handling and prevent the coupler tongue edges or other sharp objects from damaging the protective covering 28 and the core material 26.

The cut proof sleeves 34 and 36 are made up of inner and outer abrasion or wear resistant panels 40 and an inner panel 38 consisting of multiple layers of a high performance fibers and particularly Spectra fibers woven at right angles. The high performance fiber panel is sewn between the panels 40 along longitudinally extending lines 42 as shown. The composite panel layers are them wrapped around the tubular protective covering 28 at each eye section 31 to form the cut proof sleeve 34 or around adjacent leg section 30 to form the cut proof sleeves 36. The edges of the composite panel layers are then stitched together at 44.

The cross woven high performance fibers 38 will accommodate a needle to provide the stitching 42 but will resist penetration by a larger object. The longitudinal stitches 42 hold the multiple high performance fibers in place inside the cut proof sleeves. The abrasion resistent covering panel, which may be made of Cordura, protects the high performance fiber layers from abrasion damage and thus extends the life of the draw bar sling.

A calculation of the weight of my draw bar sling to lifting capacity is illustrated by the following table.

| Approximate Weight of Sling | Rated Lifting Capacity |
|---|---|
| 20 lbs | 60,000 lbs |
| 20 lbs | 80,000 lbs |
| 30 lbs | 120,000 lbs |
| 50 lbs | 200,000 lbs |

There has thus been described a unique lightweight draw bar sling for lifting heavy loads and particularly railroad cars while eliminating many of the hazards common to the use of wire rope sling arrangements. Various modifications of the described preferred embodiment will be apparent to those skilled in the art without involving any departure from the spirit and scope of our invention as defined in the appended claims.

What is claimed is:

1. A draw bar sling for lifting loads comprising:

a rigid U-shaped saddle having a central section for engaging the load and a passageway extending under the central section for receiving a sling;

a loop sling comprising a core bundle of high performance endless parallel fibers enclosed in a tubular abrasion resistant covering, the sides of the loop sling extending in a side by side relationship to form longitudinally extending parallel segments terminating at each end in a closed curve section through which a hook can be inserted for lifting the sling, the parallel segments portion of the loop sling extending through the passageway in the saddle; and a cut and abrasion resistant sleeve surrounding the loop sling along each closed curve section to substantially prevent a hook or other lifting member from penetrating into the covering and high performance fibers, the cut resistant sleeve comprising a sheet of high performance fibers woven at right angles and sewn between inner and outer sheets of abrasion resistant material, the high performance fibers of the loop sling and the cut resistant sleeve having a strength to weight ratio within the range of about 20 to 30 GPD.

2. The draw bar sling of claim 1 wherein the central section of the saddle forms a substantially flat upper surface terminating at its ends in upwardly extending lateral walls and an arcuate lower surface extending under the substantially flat upper surface thereof.

3. The draw bar sling of claim 2 wherein the saddle further includes side walls enclosing two sides of the passageway.

4. The draw bar sling of claim 3 wherein the high performance fibers have a strength to weight ratio between 23 and 27 GPD.

5. The draw bar sling of claim of claim 4 wherein the high performance fibers of the core bundle are chosen from the group consisting of Spectra and Kevlar.

6. The draw bar sling of claim 5 wherein the high performance fibers of the cut proof sleeve are made of Spectra.

7. The draw bar sling of claim 6 wherein the high performance fibers in the core are a blend of Spectra and Kevlar fibers woven into a yarn.

8. The draw bar sling of claim 7 further including a cut and abrasion resistant sleeve enclosing each side of the loop sling extending from and adjacent the saddle.

9. A draw bar sling for lifting one end of a railroad car having a coupler tongue on each end thereof comprising:

a saddle having a center section adapted to engage the coupler tongue of the railroad car and a passageway extending under the center section for receiving a lifting sling;

a loop sling comprising an endless loop of parallel synthetic high performance fibers enclosed in a tubular protective covering, the loop sling fibers having a tensile strength to weight ratio exceeding 20 GPD, the sides of the loop sling extending in a side by side relationship to form longitudinally extending parallel segments terminating at each end in a closed curve section through which a hook can be inserted, the parallel segments portion of the loop extending through the passageway in the saddle; and a cut proof sleeve surrounding the loop sling around each closed curve section to substantially prevent a hook from penetrating into the covering and high performance fibers, the sleeve comprising a sheet of high performance fibers woven at right angles and sewn to an outer sheet of a abrasion resistant material.

10. The draw bar sling of claim 9 wherein the center section of the saddle forms a substantially flat upper surface terminating at its ends in upwardly extending lateral walls and an arcuate lower surface extending under the substantially flat upper surface thereof.

11. The draw bar sling of claim 10 wherein the high performance fibers have a strength to weight ratio between 23 and 27 GPD.

12. The draw bar sling of claim of claim 11 wherein the high performance fibers of the core bundle are chosen from the group consisting of Spectra and Kevlar.

13. The draw bar sling of claim 12 wherein the high performance fibers of the cut proof sleeve are made of Spectra.

14. The draw bar sling of claim 13 further including a cut and abrasion resistant sleeve enclosing each side of the loop sling extending from and adjacent the saddle.

* * * * *